US011036164B2

(12) United States Patent
Choi et al.

(10) Patent No.: US 11,036,164 B2
(45) Date of Patent: Jun. 15, 2021

(54) TONER CARTRIDGE FOR REFILLING TONER BY USING ELASTIC FORCE

(71) Applicant: HEWLETT-PACKARD DEVELOPMENT COMPANY, L.P., Spring, TX (US)

(72) Inventors: Woong Yong Choi, Suwon (KR); Seung Gweon Lee, Pangyo (KR); Jin Hwa Hong, Suwon (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/048,020

(22) PCT Filed: Nov. 12, 2018

(86) PCT No.: PCT/KR2018/013679

§ 371 (c)(1),
(2) Date: Oct. 15, 2020

(87) PCT Pub. No.: WO2020/045743

PCT Pub. Date: Mar. 5, 2020

(65) Prior Publication Data

US 2021/0103234 A1 Apr. 8, 2021

(30) Foreign Application Priority Data

Aug. 30, 2018 (KR) ..... 10-2018-0102524

(51) Int. Cl.
*G03G 15/08* (2006.01)

(52) U.S. Cl.
CPC ..... *G03G 15/0874* (2013.01); *G03G 15/0881* (2013.01); *G03G 2215/0682* (2013.01)

(58) Field of Classification Search
CPC ..... G03G 15/0865; G03G 15/0886; G03G 15/08; G03G 15/0867; G03G 15/0877; G03G 2215/0692; B65D 83/06
See application file for complete search history.

(56) References Cited

U.S. PATENT DOCUMENTS 5,832,349 A 11/1998 Nagashima
2012/0014713 A1* 1/2012 Murakami ..... G03G 15/0865 399/119

(Continued)

FOREIGN PATENT DOCUMENTS

JP 04166963 6/1992
JP 19930170271 7/1993

(Continued)

*Primary Examiner* — Walter L Lindsay, Jr.
*Assistant Examiner* — Jessica L Eley
(74) *Attorney, Agent, or Firm* — Trop Pruner & Hu, P.C.

(57) ABSTRACT

A toner cartridge includes a container having an opening, a flexible bag in which toner is received, a sealing portion configured to seal the flexible bag, and an extension extending from an edge of the sealing portion, the flexible bag being accommodated in the container so that the sealing portion faces the opening, a rotatable member rotatably provided on the container, a movable member connected to the extension and being movable from a first position close to the opening to a second position far from the opening in a longitudinal direction of the container, a rope having a first end portion connected to the rotatable member and a second end portion connected to the movable member, and a bias member configured to elastically bias the rotatable member to rotate in a direction in which the rope is switched from an unwound state to a wound state.

15 Claims, 9 Drawing Sheets

(56) References Cited

U.S. PATENT DOCUMENTS

| | | | | |
|---|---|---|---|---|
| 2013/0209140 | A1* | 8/2013 | Murakami | G03G 15/0865 399/258 |
| 2014/0153974 | A1* | 6/2014 | Jimba | G03G 15/0879 399/262 |
| 2014/0356016 | A1* | 12/2014 | Buchanan | G03G 15/0875 399/98 |
| 2017/0119199 | A1* | 5/2017 | Williston | B65D 83/06 |
| 2018/0136583 | A1 | 5/2018 | Park et al. | |
| 2018/0311234 | A1* | 11/2018 | Payton | A61K 9/1611 |

FOREIGN PATENT DOCUMENTS

| | | |
|---|---|---|
| JP | 05313487 | 11/1993 |
| JP | 19940102757 | 4/1994 |
| JP | 19950020709 | 1/1995 |
| JP | 2000029293 | 1/2000 |
| JP | 20010075349 | 3/2001 |
| KR | 1020050047778 | 5/2005 |

* cited by examiner

[Fig. 1]
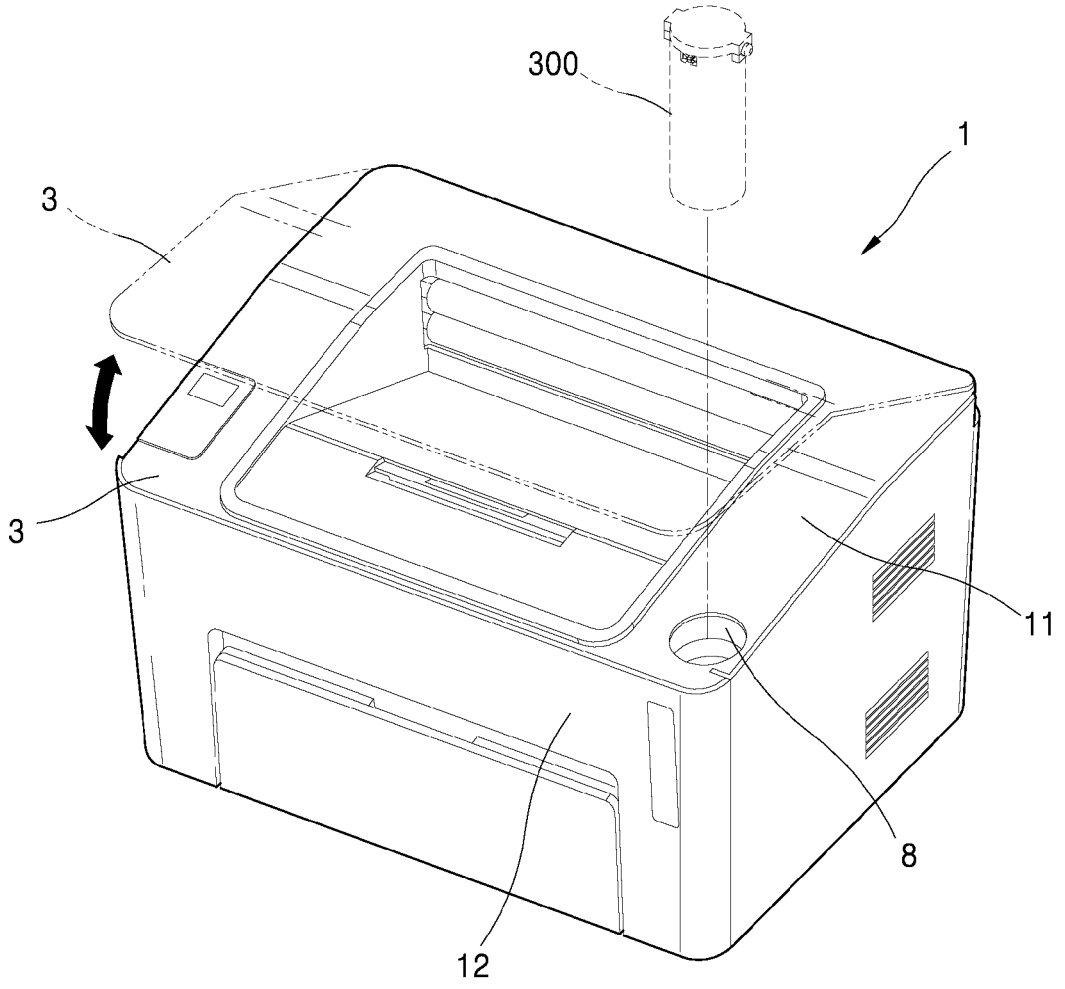

[Fig. 2]
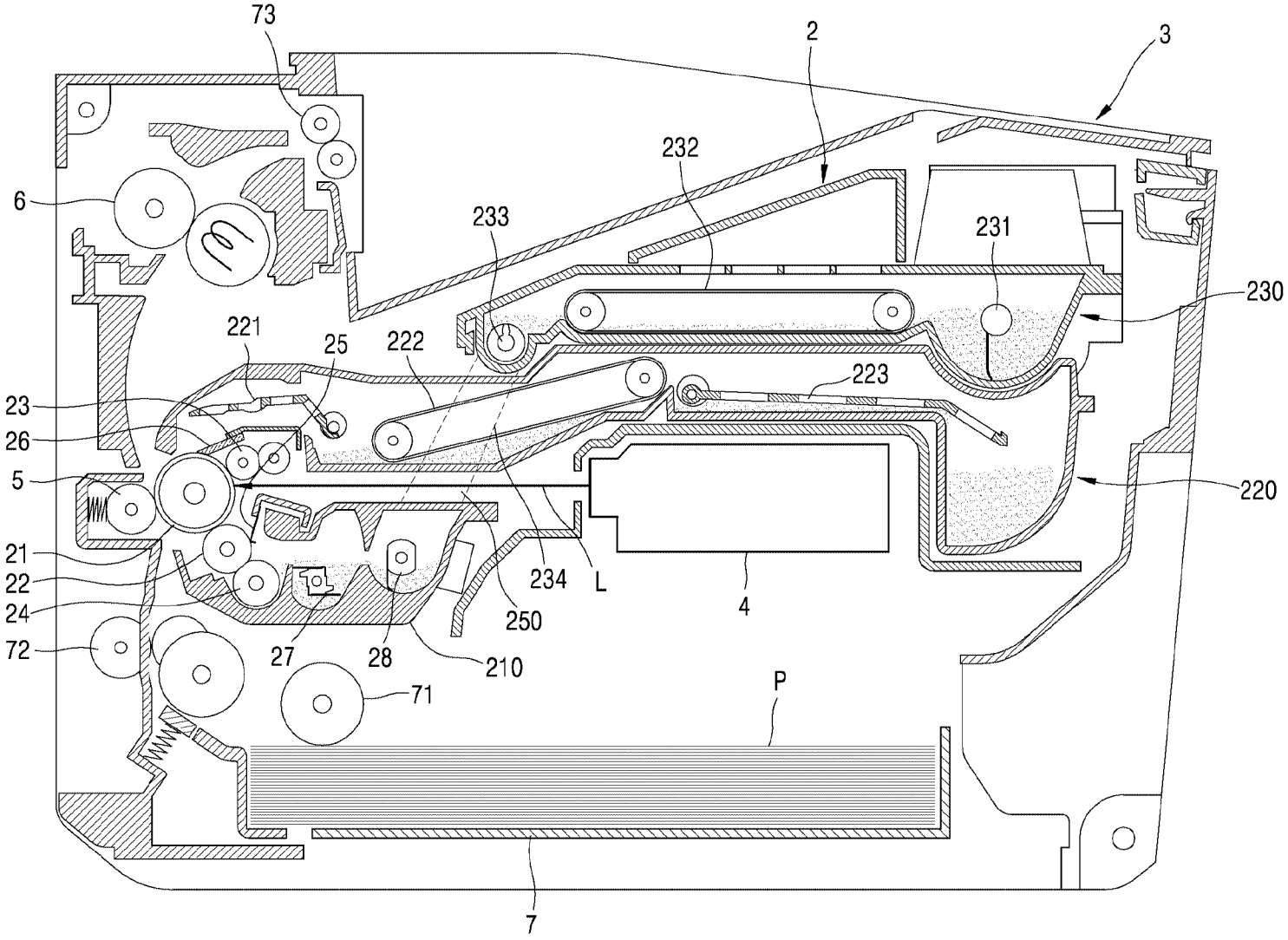

[Fig. 3]
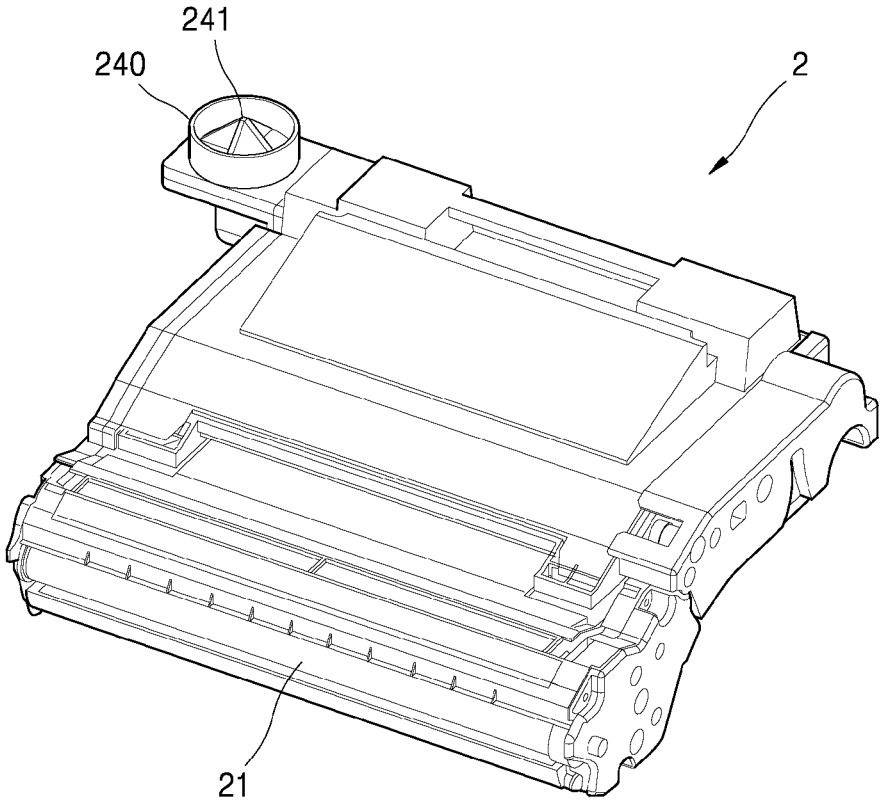

[Fig. 4]
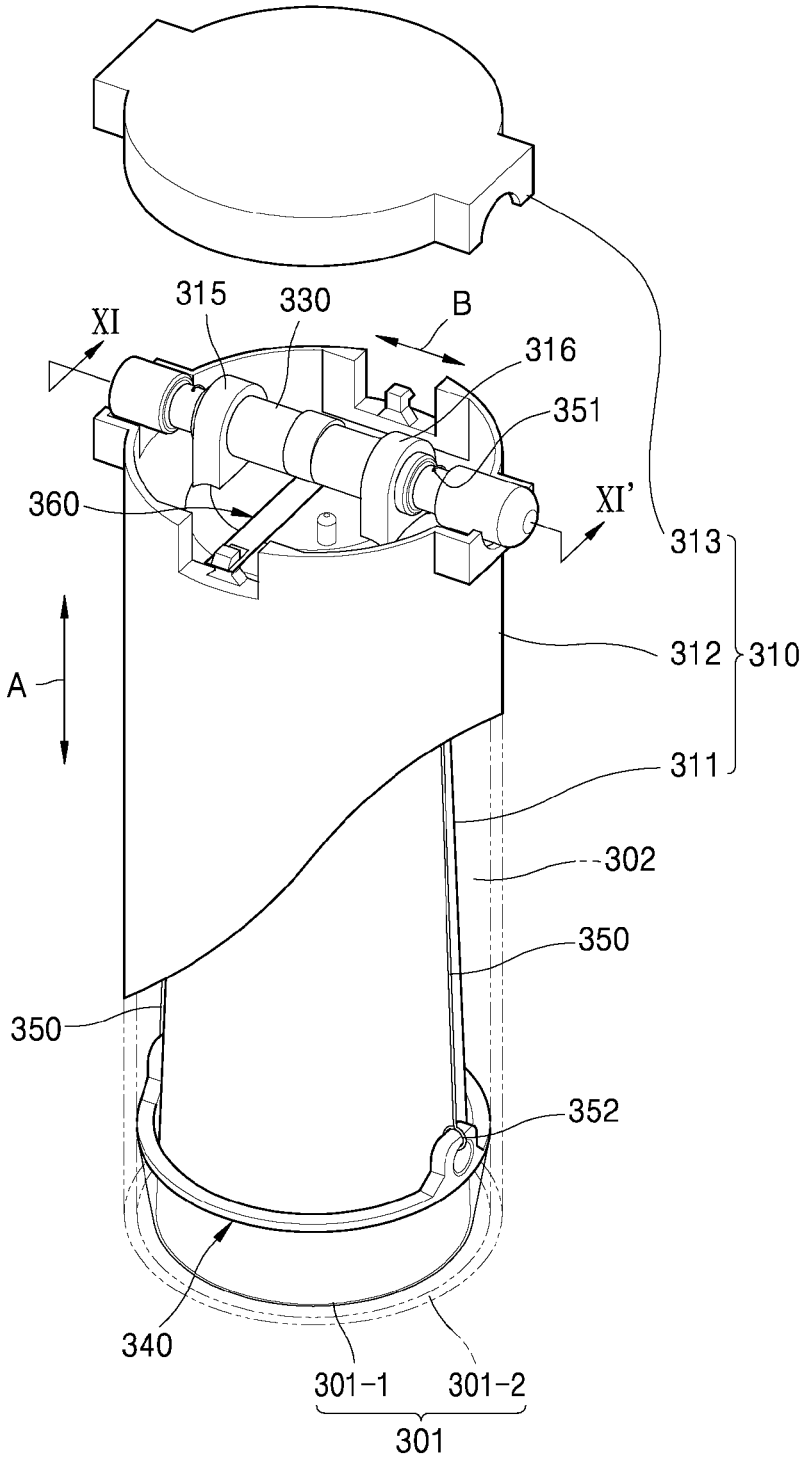

[Fig. 5]
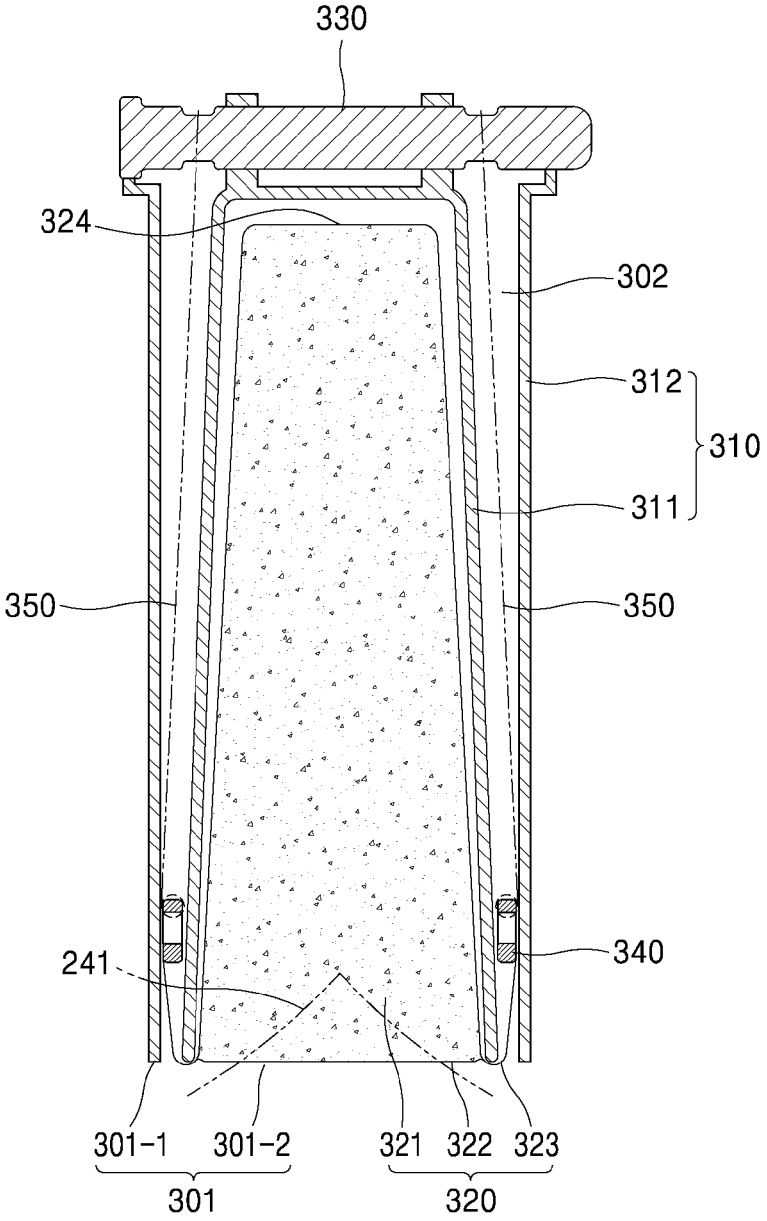

[Fig. 6]
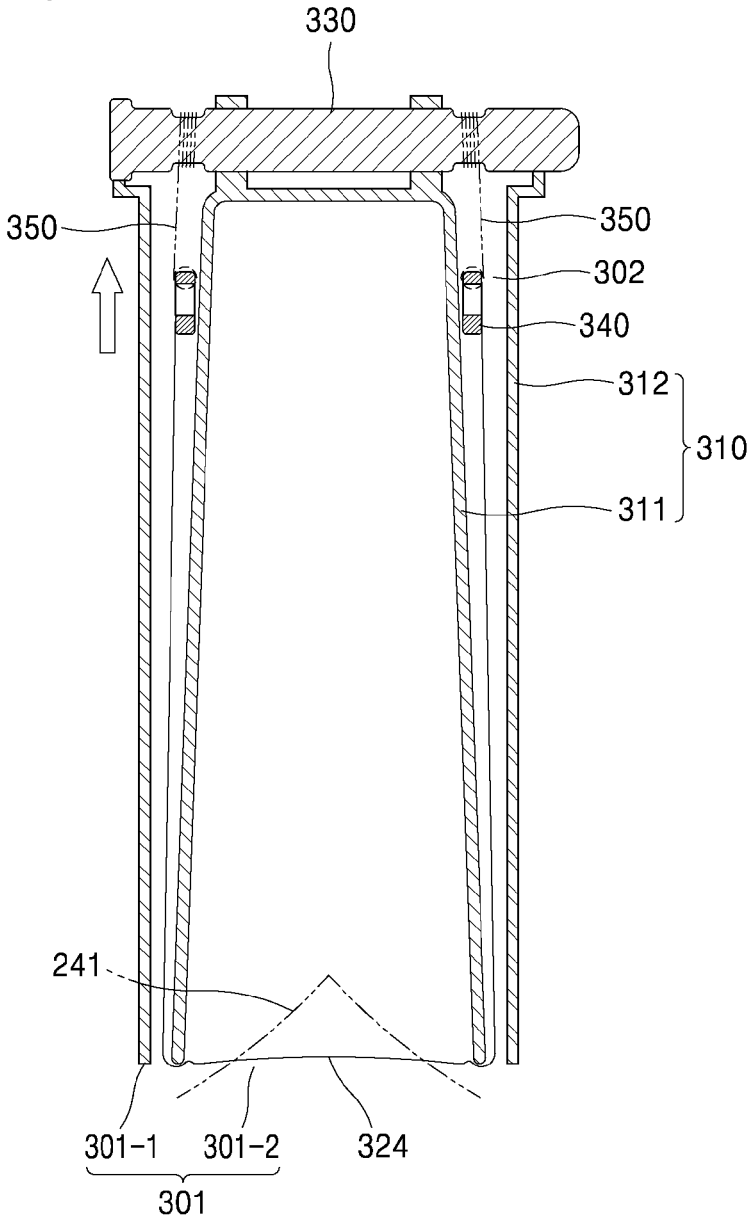

[Fig. 7]
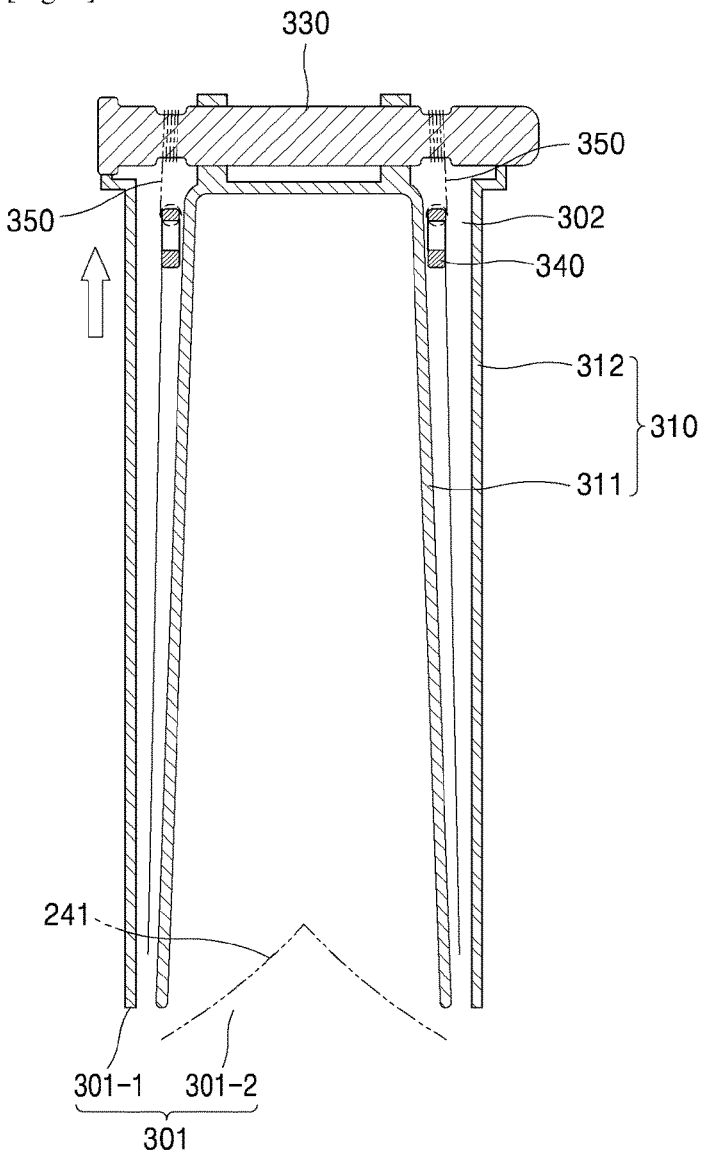
[Fig. 8]
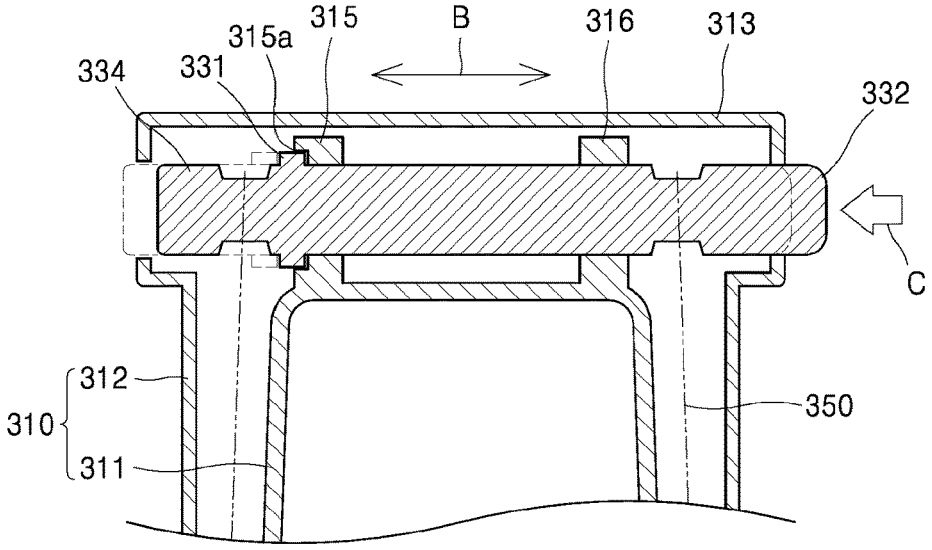

[Fig. 9]
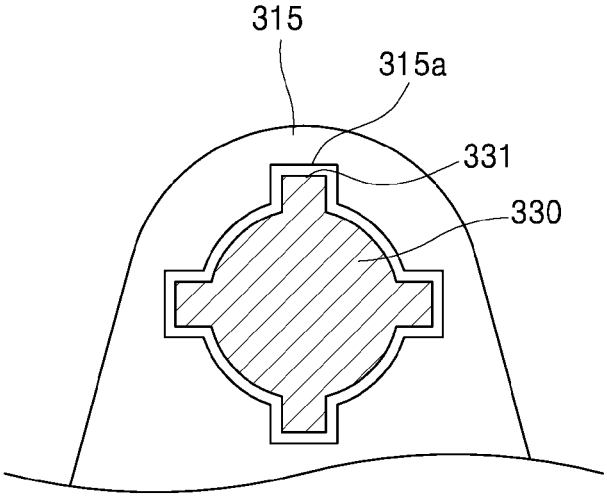
[Fig. 10]
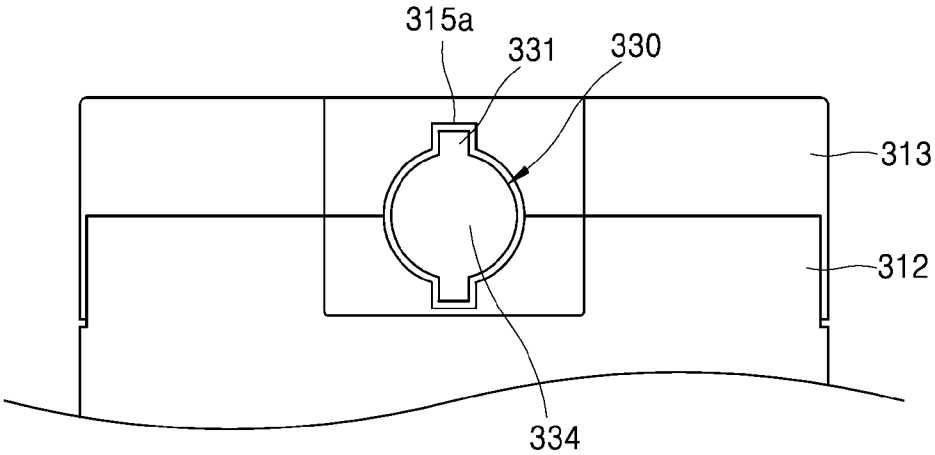
[Fig. 11]
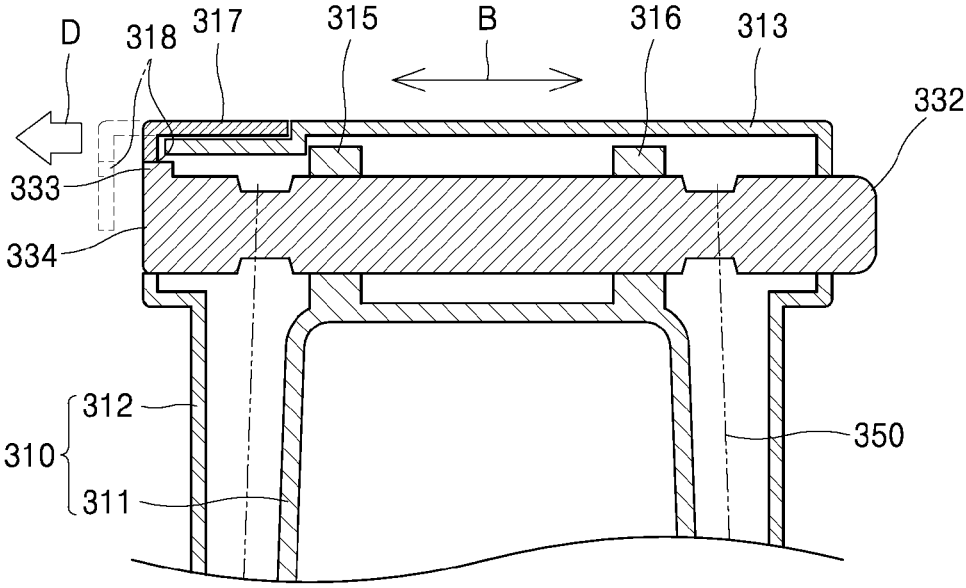

[Fig. 12]
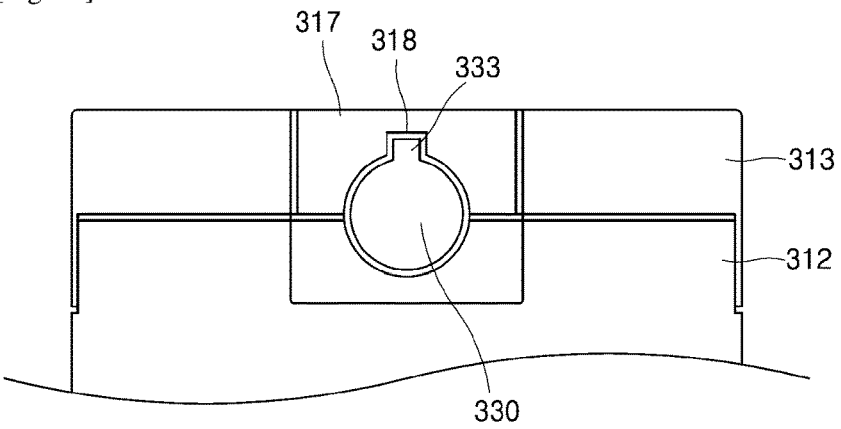
[Fig. 13]
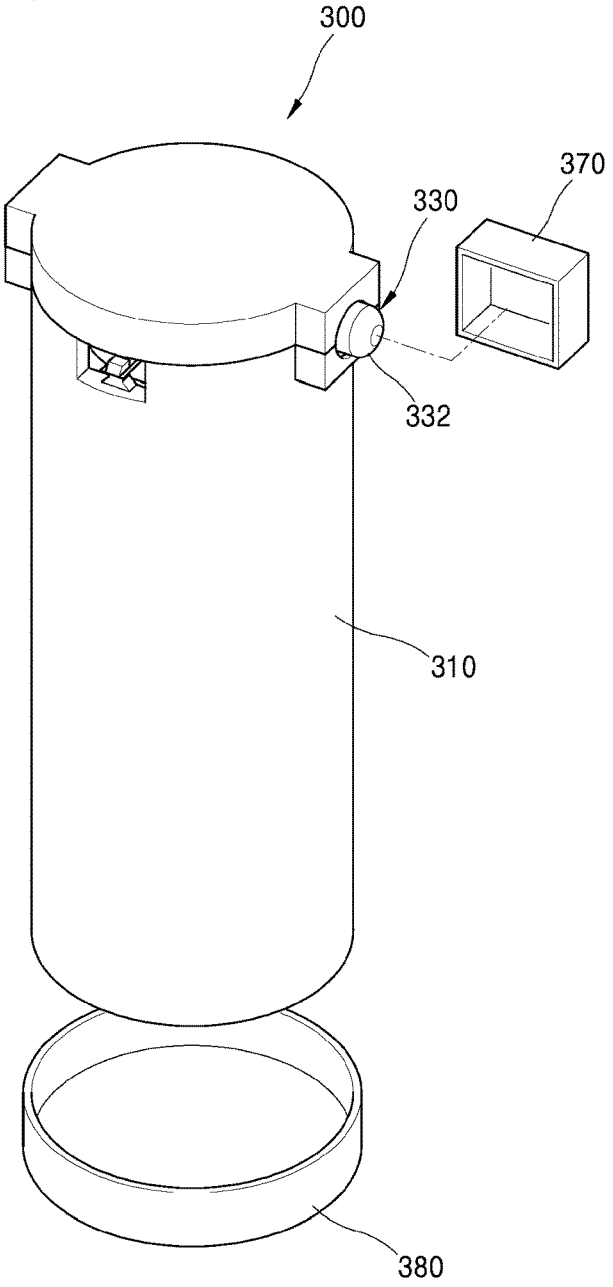

TONER CARTRIDGE FOR REFILLING TONER BY USING ELASTIC FORCE

BACKGROUND ART

A printer using an electrophotographic method forms a visible toner image on a photoconductor by supplying toner to an electrostatic latent image formed on the photoconductor, transfers the toner image to a print medium directly or through an intermediate transfer medium, and then fixes the transferred toner image on the print medium.

A development cartridge receives toner, and supplies toner to the electrostatic latent image formed on the photoconductor to form a visible toner image. When the development cartridge runs out of toner, the development cartridge may be removed from a main body of a printer and a new development cartridge may be mounted on the main body. The development cartridge may also be refilled with a new toner by using a toner refill kit (toner cartridge).

BRIEF DESCRIPTION OF DRAWINGS

FIG. 1 is a perspective view illustrating an outer appearance of an electrophotographic printer according to an example;

FIG. 2 is a view illustrating a configuration of the electrophotographic printer of FIG. 1 according to an example;

FIG. 3 is a perspective view of a development cartridge used in the electrophotographic printer of FIG. 1, according to an example;

FIG. 4 is a partial exploded perspective view of a toner cartridge according to an example;

FIG. 5 is a cross-sectional view taken along a line XI-XI' of FIG. 4, illustrating a state where a movable member is located at a first position;

FIG. 6 is a cross-sectional view taken along the line XI-XI' of FIG. 4, illustrating a state where the movable member is located at a second position;

FIG. 7 is a cross-sectional view taken along the line XI-XI' of FIG. 4, illustrating another state where the movable member is located at the second position;

FIGS. 8 and 9 are partial cross-sectional views of a locking portion of FIG. 9 according to an example;

FIG. 10 is a side view of the locking portion according to an example;

FIG. 11 is a partial cross-sectional view of a locking portion according to an example;

FIG. 12 is a side view of the locking portion of FIG. 11, according to an example; and FIG. 13 is a perspective view of the toner cartridge according to an example.

MODE FOR THE INVENTION

FIG. 1 is a perspective view illustrating an outer appearance of an electrophotographic printer according to an example. FIG. 2 is a view illustrating a configuration of the electrophotographic printer of FIG. 1 according to an example. FIG. 3 is a perspective view of a development cartridge used in the electrophotographic printer of FIG. 1, according to an example. Referring to FIGS. 1, 2, and 3, a printer may include a main body 1 and a development cartridge 2 attachable to/detachable from the main body 1. A door 3 may be provided on the main body 1. The door 3 opens/closes a portion of the main body 1. Although the door 3 opens an upper portion of the main body 1 in FIG. 1, a door for opening a side portion of the main body 1 or a front portion of the main body 1 may be used, if necessary. The door 3 may be opened and the development cartridge 2 may be attached to/detached from the main body 1.

A photosensitive drum 21 that is a photoconductor on which an electrostatic latent image is formed may include a cylindrical metal pipe and a photosensitive layer having photoconductivity and formed on an outer circumferential surface of the cylindrical metal pipe. A charging roller 23 is a charger for charging a surface of the photosensitive drum 21 to a uniform electric potential. A charging bias voltage is applied to the charging roller 23. A corona charger (not shown), instead of the charging roller 23, may be used. A developing roller 22 supplies toner to the electrostatic latent image formed on the surface of the photosensitive drum 21 and develops the electrostatic latent image.

When a two-component development method using toner and a carrier as a developer is used, the developing roller 22 may include a rotating sleeve and a magnet fixedly located inside the rotating sleeve. The rotating sleeve may be spaced apart from the photosensitive drum 21 by tens to hundreds of micrometers. The carrier is attached to an outer circumferential surface of the developing roller 22 due to a magnetic force of the magnet, and the toner is attached to the carrier due to an electrostatic force, and thus a magnetic brush formed of the carrier and the toner is formed on the outer circumferential surface of the developing roller 22. The toner is moved to the electrostatic latent image formed on the photosensitive drum 21 due to a developing bias voltage applied to the developing roller 22.

When a one-component development method using toner as a developer is used, the developing roller 22 may contact the photosensitive drum 21, or may be spaced apart from the photosensitive drum 21 by tens to hundreds of micrometers. In the example, a one-component development method in which a development nip is formed when the developing roller 22 and the photosensitive drum 21 contact each other is used. The developing roller 22 may include a conductive metal core (not shown) and an elastic layer (not shown) formed on an outer circumferential surface of the conductive metal core. When a developing bias voltage is applied to the developing roller 22, the toner is moved and attached to the electrostatic latent image formed on the surface of the photosensitive drum 21 through the development nip.

A supply roller 24 allows toner to be attached to the developing roller 22. A supply bias voltage may be applied to the supply roller 24 so that toner is attached to the developing roller 22. Reference numeral 25 denotes a regulating member for regulating the amount of toner attached to a surface of the developing roller 22. The regulating member 25 may be a regulating blade whose front end contacts the developing roller 22 at a predetermined pressure. Reference numeral 26 denotes a cleaning member for removing residual toner and a foreign material from the surface of the photosensitive drum 21 before a charging operation. The cleaning member 26 may be a cleaning blade whose front end contacts the surface of the photosensitive drum 21. Hereinafter, the foreign material removed from the surface of the photosensitive drum 21 is referred to as waste toner.

An optical scanner 4 scans light modulated according to image information to the surface of the photosensitive drum 21 charged to a uniform electric potential. A laser scanning unit (LSU) of deflecting light emitted from a laser diode in a main scanning direction by using a polygon mirror and scanning the deflected light to the photosensitive drum 21 may be used as the optical scanner 4.

A transfer roller 5 is a transfer unit facing the photosensitive drum 21 and configured to form a transfer nip. A transfer bias voltage for transferring the toner image developed on the surface of the photosensitive drum 21 to a print medium P is applied to the transfer roller 5. A corona transfer unit, instead of the transfer roller 5, may be used.

The toner image transferred to a surface of the print medium P by the transfer roller 5 is maintained on the surface of the print medium P due to electrostatic attraction. A fuser 6 forms a permanent print image on the print medium P by fixing the toner image onto the print medium P by applying heat and pressure.

Referring to FIGS. 2 and 3, the development cartridge 2 of the example includes a developing portion 210 in which the photosensitive drum 21 and the developing roller 22 are provided, a waste toner container 220 in which waste toner removed from the photosensitive drum 21 is received, and a toner container 230 connected to the developing portion 210 and allowing toner to be received therein. In order to refill the toner container 230 with toner, the development cartridge 2 includes a toner refilling portion 240 connected to the toner container 230. The toner refilling portion 240 provides an interface between a toner cartridge 300 and the development cartridge 2. The development cartridge 2 is an integrated development cartridge including the developing portion 210, the waste toner container 220, the toner container 230, and the toner refilling portion 240.

A portion of an outer circumferential surface of the photosensitive drum 21 is exposed to the outside of a housing. The transfer roller 5 contacts the exposed portion of the photosensitive drum 21 to form a transfer nip. At least one conveying member for conveying toner to the developing roller 22 may be provided on the developing portion 210. The conveying member may agitate the toner and may charge the toner to a predetermined electric potential.

The waste toner container 220 is located over the developing portion 210. The waste toner container 220 is spaced apart from the developing portion 210 so that a light path 250 is formed between the waste toner container 220 and the developing portion 210. Waste toner removed from the photosensitive drum 21 by the cleaning member 26 is received in the waste toner container 220. The waste toner removed from the surface of the photosensitive drum 21 is transported into the waste toner container 220 by one or more waste toner transporting members 221, 222, and 223. Shapes and the number of waste toner transporting members are not limited. An appropriate number of waste toner transporting members may be provided at appropriate positions in order to effectively disperse the waste toner in the waste toner container 220 in consideration of a volume or a shape of the waste toner container 220.

The toner container 230 is connected to the toner refilling portion 240 and receives toner. The toner container 230 is connected to the developing portion 210 by a toner supply portion 234 as marked by a dashed line of FIG. 2. As shown in FIG. 2, the toner supply portion 234 may vertically pass through the waste toner container 220 and may be connected to the developing portion 210. The toner supply portion 234 is located outside an effective width of exposure light L in order not to interfere with the exposure light L scanned in the main scanning direction by the optical scanner 4.

One or more toner supply members 231, 232, and 233 for supplying toner through the toner supply portion 234 to the developing portion 210 may be provided in the toner container 230. Shapes and the number of toner supply members are not limited. An appropriate number of toner supply members may be provided at appropriate positions in the toner container 230 in order to effectively supply the toner to the developing portion 210 in consideration of a volume or a shape of the toner container 230. The toner supply member 233 may convey the toner in the main scanning direction to the toner supply portion 234.

An image forming process will now be described briefly. A charging bias voltage is applied to the charging roller 23, and the photosensitive drum 21 is charged to a uniform electric potential. The optical scanner 4 forms an electrostatic latent image on a surface of the photosensitive drum 21 by scanning light modulated to correspond to image information to the photosensitive drum 21. The supply roller 24 allows toner to be attached to a surface of the developing roller 22. The regulating member 25 forms a toner layer having a uniform thickness on the surface of the developing roller 22. A developing bias voltage is applied to the developing roller 22. As the developing roller 22 rotates, the toner conveyed to a development nip is moved and attached to the electrostatic latent image formed on the surface of the photosensitive drum 21 due to the developing bias voltage and a visible toner image is formed on the surface of the photosensitive drum 21. The print medium P picked up from a loading tray 7 by a pickup roller 71 is fed by a feed roller 72 to a transfer nip where the transfer roller 5 and the photosensitive drum 21 face each other. When a transfer bias voltage is applied to the transfer roller 5, the toner image is transferred to the print medium P due to electrostatic attraction. The toner image transferred to the print medium P is fixed onto the print medium P due to heat and pressure applied by the fuser 6, thereby completing a printing operation. The print medium P is discharged by a discharge roller 73. A portion of the toner remaining on the surface of the photosensitive drum 21 without being transferred to the print medium P is removed by the cleaning member 26.

As described above, the development cartridge 2 includes the toner refilling portion 240 for refilling toner. Accordingly, the development cartridge 2 may be refilled with toner in a state where the development cartridge 2 is mounted on the main body 1, without being removed from the main body 1.

Referring to FIG. 1, a communicating portion 8 is formed in the main body 1 so that the toner refilling portion 240 may be accessed from the outside of the main body 1 in a state where the development cartridge 2 is mounted on the main body 1. For example, when the toner cartridge (e.g., a toner refill kit) 300 in which toner is received is inserted into the communicating portion 8, the toner cartridge 300 may be connected to the toner refilling portion 240. In this state, the toner received in the toner cartridge 300 may be refilled in the toner container 230 through the toner refilling portion 240. The toner cartridge 300 is removed from the communicating portion 8 after the toner is refilled.

In this configuration, since toner may be refilled in the toner container 230 through the toner refilling portion 240, a replacement time of the development cartridge 2 may be extended until a lifetime of the photosensitive drum 21 ends, thereby reducing printing costs per sheet. Since toner may be refilled in a state where the development cartridge 2 is mounted on the main body 1, user convenience may be improved.

The communicating portion 8 may be provided at a position close to a front portion 12 (see FIG. 1) of the main body 1. Since the front portion 12 faces a user, the user may easily access the communicating portion 8. Accordingly, a toner refilling operation through the communicating portion 8 may be easily performed.

The communicating portion 8 may be formed in a top surface 11 of the main body 1. The toner refilling portion 240 is located under the communicating portion 8. The communicating portion 8 and the toner refilling portion 240 may be vertically aligned with each other. The toner cartridge 300 may access the toner refilling portion 240 from the top of the main body 1 through the communicating portion 8.

Examples of the toner cartridge 300 will now be described.

FIG. 4 is a partial exploded perspective view of the toner cartridge 300 according to an example. FIG. 5 is a cross-sectional view taken along a line XI-XI' of FIG. 4, illustrating a state where a movable member is located at a first position. FIG. 6 is a cross-sectional view taken along the line XI-XI' of FIG. 4, illustrating a state where the movable member is located at a second position. Referring to FIGS. 4, 5, and 6, the toner cartridge 300 may include a container 310 having an opening 301 formed at a side thereof in a longitudinal direction A, a flexible bag 320 accommodated in the container 310 and configured to receive toner, a rotatable member 330 rotatably provided on the container 310, a movable member 340 movable in the longitudinal direction A of the container 310, a rope 350 configured to connect the rotatable member 330 and the movable member 340, and a bias member 360 configured to elastically bias the rotatable member 330 so that the rotatable member 330 rotates in a direction to wind up the rope 350 thereon.

An extension 323 extending beyond the opening 301 may be provided at one end portion of the flexible bag 320 in the longitudinal direction A. The flexible bag 320 may include a receiving portion 321 for receiving toner and a sealing portion 322 for sealing the receiving portion 321. The extension 323 may extend from an edge of the sealing portion 322. The flexible bag 320 may be accommodated in the container 310 so that the sealing portion 322 faces the opening 301.

The flexible bag 320 may be formed of a material that may be flexibly inverted as described below. For example, the flexible bag 320 may be formed of a polyethylene (PE) sheet, a low-density polyethylene (LDPE) sheet, or a polyamide (PA) sheet. Although a thickness of the flexible bag 320 may be, for example, 0.1 mm or less, a thickness of the flexible bag 320 is not limited as long as the flexible bag 320 may be flexibly inverted. The sealing portion 322 may be formed of the same material as that of the flexible bag 320. After toner is refilled in the receiving portion 321, an opened portion of the flexible bag 320 may be sealed by using, for example, ultrasound welding or thermal welding. In this case, the sealing portion 322 may be defined by a portion of the flexible bag 320 facing the opening 301. The sealing portion 322 may be formed of a material different from that of the flexible bag 320. In this case, the sealing portion 322 may be formed of a material that may be easily torn by a breaking member 241 that is described below. After toner is refilled in the receiving portion 321 through the opened portion of the flexible bag 320, a material of the sealing portion 322 may be adhered to the opened portion of the flexible bag 320 by using, for example, ultrasound welding or thermal welding.

The movable member 340 is movable in the longitudinal direction A of the container 310. For example, the movable member 340 may have a ring shape surrounding an outer surface of the container 310. The extension 323 extends beyond the opening 301 and is connected to the movable member 340. The movable member 340 is movable from a first position (see FIG. 5) close to the opening 301 in the longitudinal direction A of the container 310 to a second position (see FIG. 6) far from the opening 301.

The rotatable member 330 is rotatably provided on the container 310. The rotatable member 330 may be located opposite to the opening 301. The rotatable member 330 may be rotatably provided on one pair of support portions 315 and 316 provided on the container 310 to cross the container 310 in a radial direction.

A first end portion 351 of the rope 350 is connected to the rotatable member 330 and a second end portion 352 is connected to the movable member 340. The rope 350 may have an unwound state (see FIG. 5) in which the rope 350 is released from the rotatable member 330 and the movable member 340 is located at the first position and a wound state (see FIG. 6) in which the rope 350 is wound around the rotatable member 330 and the movable member 340 is located at the second position. The rotatable member 330 and the movable member 340 are connected to each other by two ropes 350 in the example. The two ropes 350 are spaced apart from each other in an axial direction B of the rotatable member 330.

The bias member 360 elastically biases the rotatable member 330 so that the rope 350 rotates to be switched from the unwound state to the wound state. For example, the bias member 360 may include a spiral spring having a first end portion connected to the container 310 and a second end portion connected to the rotatable member 330. The bias member 360 may include an elastic band (e.g., a rubber band) having a first end portion connected to the container 310 and a second end portion connected to the rotatable member 330.

The container 310 may include an inner container 311 and an outer container 312 that extend in the longitudinal direction A and overlap each other with a gap 302 therebetween. The flexible bag 320 is accommodated in the inner container 311. The inner container 311 is accommodated in the outer container 312. Openings 301-1 and 301-2 are formed at sides of the inner container 311 and the outer container 312 in the longitudinal direction A. The openings 301-1 and 301-2 constitute the opening 301 of the container 310. Each of the inner container 311 and the outer container 312 may have a hollow cylindrical shape. Reference numeral 313 denotes an upper cover covering an opened upper portion of the outer container 312.

The rotatable member 330 is rotatably supported on one pair of support portions 315 and 316 provided on the inner container 311. The movable member 340 and the rope 350 may be located in the gap 302. The movable member 340 is movable in the gap 302 in the longitudinal direction A. The movable member 340 may have a ring shape surrounding an outer surface of the inner container 311. The inner container 311 has a cross-sectional area decreasing away from the opening 301 so that the movable member 340 is easily movable in the longitudinal direction A.

Referring to FIG. 5, the movable member 340 is located at the first position. The rotatable member 330 is biased by the bias member 360 in a direction in which the rope 350 is wound around the rotatable member 330. Since the flexible bag 320 is accommodated in the container 310, that is, the inner container 311, in a state where the flexible bag 320 is sealed by the sealing portion 322, the flexible bag 320 is not pulled out from the inside of the inner container 311. Accordingly, despite an elastic force of the bias member 360, the rotatable member 330 does not rotate and the movable member 340 is maintained at the first position. Due to the bias member 360, a tensile force is applied to the rope 350 and the flexible bag 320 through the rotatable member 330.

When the toner cartridge 300 is inserted into the main body 1 through the communicating portion 8 in this state, an end portion of the container 310 close to the opening 301 is coupled to the toner refilling portion 240. The breaking member 241 for tearing the sealing portion 322 of the flexible bag 320 is provided on the toner refilling portion 240 as shown in FIG. 3. The breaking member 241 may have any of various shapes for tearing the sealing portion 322 such as a pointed blade shape or a cross blade shape.

When the toner cartridge 300 is coupled to the toner refilling portion 240, the sealing portion 322 is torn by the breaking member 241. Toner received in the receiving portion 321 passes through the torn sealing portion 322 and is supplied to the development cartridge 2. As the toner in the receiving portion 321 enters the development cartridge 2, a free space is formed in the receiving portion 321. The flexible bag 320 escapes to the outside of the container 310 through the opening 301 by a length corresponding to the free space. Since a tensile force is applied to the rope 350 through the rotatable member 330 by the bias member 360, the movable member 340 is pulled toward the second position. The rotatable member 330 rotates in a direction in which the rope 350 is wound around the rotatable member 330 as much as the movable member 340 moves. The flexible bag 320 is inverted due to an elastic force applied by the bias member 360. The inverted flexible bag 320 is pulled toward the opening 301. Accordingly, the toner in the receiving portion 321 may be easily and completely supplied into the development cartridge 2.

As such, since the bias member 360 is used to turn the flexible bag 320 toward the opening 301, toner may be easily and completely supplied to the development cartridge 2 without a user's manipulation.

FIG. 7 is a cross-sectional view taken along the line XI-XI' of FIG. 4, illustrating another state where the movable member is located at the second position. When the flexible bag 320 is inverted and is completely removed from the opening 301, an upper wall 324 of the receiving portion 321 may be torn by the breaking member 241. Then, as shown in FIG. 7, the flexible bag 320 may be completely inverted and may be accommodated in the gap 302 to surround an outer circumferential surface of the inner container 311.

In a structure including the inner container 311 and the outer container 312, since the flexible bag 320 is completely inverted and is accommodated in the gap 302, the possibility that a user's hand is contaminated by toner when the toner cartridge 300 is handled may be reduced. Also, the possibility that, the inside of the main body 1 is contaminated with toner when the toner cartridge 300 is removed from the main body 1 may be reduced.

A structure in which the rotatable member 330 is locked when the rope 350 is in an unwound state and the rotatable member 330 is unlocked before or after toner is supplied to the main body 1 may also be used. The toner cartridge 300 includes a locking portion for locking the rotatable member 330 when the rope 350 is in an unwound state.

FIGS. 8 and 9 are partial cross-sectional views of a locking portion according to an example. Referring to FIGS. 8 and 9, the rotatable member 330 is rotatably supported on one pair of support portions 315 and 316 provided on the inner container 311. The locking portion may include one or more protrusions 331 protruding outward from the rotatable member 330 and grooves 315*a* formed in the support portion 315 to receive the protrusions 331. The grooves 315*a* partially extend in the axial direction B. In this configuration, the rotatable member 330 does not rotate in a state where the protrusions 331 are received in the grooves 315*a*.

The rotatable member 330 may be released from the locking portion by moving in the axial direction B. The rotatable member 330 may move in the axial direction B from a locking position (marked by a solid line of FIG. 8) at which the rotatable member 330 is locked by the locking portion to a release position (marked by a dashed line of FIG. 8) at which the rotatable member 330 is released from the locking portion. For example, a first end portion 332 of the rotatable member 330 outwardly protrudes beyond the container 310, e.g., the outer container 312. The first end portion 332 may function as a button for moving the rotatable member 330 to the release position. In this configuration, before or after the toner cartridge 300 is mounted on the main body 1, the rotatable member 330 may be released from the locking portion by pushing the first end portion 332 of the rotatable member 330 in the axial direction B as marked by an arrow C of FIG. 8 and removing the protrusions 331 from the grooves 315*a*.

Although the grooves 315*a* are formed in the support portion 315 in FIGS. 8 and 9, the grooves 315*a* may be formed in another portion of the container 310. FIG. 10 is a side view of the locking portion according to an example. Referring to FIG. 10, the protrusions 331 may be provided on a second end portion 334 of the rotatable member 330, and the grooves 315*a* may be formed in the container 310, e.g., the outer container 312 and/or the outer container 312 and the upper cover 313. Before or after the toner cartridge 300 is mounted on the main body 1, the rotatable member 330 may be released from the locking portion by pushing the first end portion 332 of the rotatable member 330 in the axial direction B as marked by the arrow C of FIG. 8 and removing the protrusions 331 from the grooves 315*a*.

FIG. 11 is a partial cross-sectional view of a locking portion according to an example. FIG. 12 is a side view of the locking portion of FIG. 11, according to an example. Referring to FIGS. 11 and 12, the rotatable member 330 is rotatably supported on one pair of support portions 315 and 316 provided on the inner container 311. At least one protrusion 333 protrudes outward from the second end portion 334 of the rotatable member 330 in a radial direction. The locking portion may include a lock lever 317 including a groove 318 in which the protrusion 333 is received. The lock lever 317 may be provided to be movable to a third position (marked by a solid line of FIG. 11) at which the rotatable member 330 is locked on the container 310, e.g., the upper cover 313 and a fourth position (marked by a dashed line of FIG. 11) at which the rotatable member 330 is released from the container 310. At the third position, the protrusion 333 is inserted into the groove 318. Accordingly, the rotatable member 330 does not rotate. When the lock lever 317 moves to the fourth position, the protrusion 333 is removed from the groove 318 and the rotatable member 330 is released.

In this configuration, before or after the toner cartridge 300 is mounted on the main body 1, the rotatable member 330 may be released from the locking portion by pushing the lock lever 317 in the axial direction B as marked by an arrow D of FIG. 11 and removing the protrusion 333 from the groove 318.

Due to the locking portion, a tensile force applied to the rope 350 and the flexible bag 320 by the bias member 360 may be released. Accordingly, the risk of deformation of the extension 323 of the flexible bag 320 or the rope 350 during long-term storage of the toner cartridge 300 and the risk of malfunction of the toner cartridge 300 may be reduced.

FIG. 13 is a perspective view of the toner cartridge 300 according to an example. Referring to FIG. 13, the toner cartridge 300 may further include an anti-pressing member 370 covering the first end portion 332 of the rotatable member 330 so that the first end portion 332 is prevented from being pressed. The anti-pressing member 370 may be removably coupled to the container 310. In this configuration, the rotatable member 330 may be prevented from being pressed and being released unexpectedly when the toner cartridge 300 is manufactured and handled. Before or after the toner cartridge 300 is mounted on the main body 1, the anti-pressing member 370 may be removed and the rotatable member 330 may be released by pressing the first end portion 332 of the rotatable member 330.

Referring to FIG. 13, the toner cartridge 300 may include a protective cover 380 covering the opening 301 of the container 310. The protective cover 380 may be removably coupled to the container 310. The sealing portion 322 (see FIG. 5) may be prevented from being exposed through the opening 301 by coupling the protective cover 380 to the container 310. In this configuration, the sealing portion 322 may be prevented from being damaged unexpectedly when the toner cartridge 300 is manufactured and handled. Before the toner cartridge 300 is mounted on the main body 1, the sealing portion 322 may be exposed by removing the protective cover 380.

Although an electrophotographic printer to which the toner cartridge 300 is applied has been described with reference to FIGS. 1 through 3, a structure of a printer is not limited to that of FIGS. 1 through 3. Although not shown, a toner container (not shown) including the toner refilling portion 240 and connected to the development cartridge 2 may be provided on the main body 1, and the toner cartridge 300 may refill toner in the toner container. Also, even in a state where the development cartridge 2 is removed from the main body 1, the toner cartridge 300 may be coupled to the toner refilling portion 240 and the development cartridge 2 may be refilled with toner. The toner cartridge 300 may be connected to the toner refilling portion 240 in a state where the toner container is removed from the main body 1, and the toner container may be refilled with toner.

While the disclosure has been shown and described with reference to examples thereof, they are provided for illustration and it will be understood by one of ordinary skill in the art that various modifications and equivalent other examples may be made from the disclosure. Accordingly, the true technical scope of the disclosure is defined by the technical spirit of the appended claims.

The invention claimed is:

1. A toner cartridge, comprising:

a container having a side with an opening;

a flexible bag including a receiving portion in which toner is received, a sealing portion to seal the receiving portion, and an extension extending from an edge of the sealing portion, the flexible bag being accommodated in the container so that the sealing portion faces the opening;

a rotatable member rotatably provided on the container;

a movable member connected to the extension and being movable in a longitudinal direction of the container from a first position to a second position, the first position being closer to the opening than the second position;

a rope having a first end portion connected to the rotatable member and a second end portion connected to the movable member, and having an unwound state in which the rope is unwound from the rotatable member and the movable member is located at the first position and a wound state in which the rope is wound around the rotatable member and the movable member is located at the second position; and a bias member to elastically bias the rotatable member to rotate in a direction in which the rope is switched from the unwound state to the wound state.

2. The toner cartridge of claim 1, further comprising a locking portion to lock the rotatable member when the rope is in the unwound state.

3. The toner cartridge of claim 2, wherein the rotatable member is movable in an axial direction of the rotatable member from a locking position at which the rotatable member is locked by the locking portion to a release position at which the rotatable member is released from the locking portion.

4. The toner cartridge of claim 3, wherein an end portion of the rotatable member outwardly protrudes beyond the container.

5. The toner cartridge of claim 2, wherein the locking portion is movable to a third position at which the rotatable member is locked and a fourth position at which the rotatable member is released.

6. The toner cartridge of claim 1, wherein the bias member includes a spiral spring having a first end portion connected to the container and a second end portion connected to the rotatable member.

7. The toner cartridge of claim 1, wherein the bias member includes an elastic band having a first end portion connected to the container and a second end portion connected to the rotatable member.

8. The toner cartridge of claim 1, wherein the container includes:

an inner container to receive the flexible bag therein, and an outer container to receive the inner container therein with a gap extending along the longitudinal direction between the outer container and the inner container.

9. The toner cartridge of claim 8, wherein the inner container has a shape such that the gap increases in the longitudinal direction from the side of the container with the opening toward an opposite side of the container.

10. The toner cartridge of claim 8, wherein the movable member and the rope are located in the gap.

11. A toner cartridge, comprising:

an inner container having a side with an opening;

an outer container to receive the inner container therein, having a side with an opening, and a gap extends along a longitudinal direction of the outer container between the inner container and the outer container;

a flexible bag to receive toner and be accommodated in the inner container, and including an extension provided at an end portion of the flexible bag and extending beyond the opening of the inner container in the longitudinal direction;

a movable member connected to the extension and being movable in the longitudinal direction in the gap;

a rotatable member rotatably provided on the inner container;

a rope to connect the rotatable member and the movable member, and having an unwound state in which the rope is unwound from the rotatable member and a wound state in which the rope is wound around the rotatable member to move the movable member;

a bias member to elastically bias the rotatable member in a direction in which the rope is switched from the unwound state to the wound state; and a locking portion to lock the rotatable member when the rope is in the unwound state.

12. The toner cartridge of claim 11, wherein the rotatable member is axially movably provided on the inner container, and is movable to a locking position at which the rotatable member is locked by the locking portion and a release position at which the rotatable member is released from the locking portion.

13. The toner cartridge of claim 12, wherein an end portion of the rotatable member outwardly protrudes beyond the outer container.

14. The toner cartridge of claim 11, wherein the inner container has a shape such that the gap increases in the longitudinal direction from the side of the opening of the inner container toward an opposite side of the inner container.

15. The toner cartridge of claim 11, wherein the bias member includes a spiral spring having a first end portion connected to the inner container and a second end portion connected to the rotatable member.

* * * * *